US010777869B2

(12) United States Patent
Kim et al.

(10) Patent No.: US 10,777,869 B2
(45) Date of Patent: Sep. 15, 2020

(54) CAVITY TYPE WIRELESS FREQUENCY FILTER HAVING CROSS-COUPLING NOTCH STRUCTURE

(71) Applicant: KMW INC., Hwaseong-si (KR)

(72) Inventors: Joung-Hoe Kim, Hwaseong-si (KR); Sung-Ho Jang, Yongin-si (KR)

(73) Assignee: KMW INC., Hwaseong-si (KR)

( * ) Notice: Subject to any disclaimer, the term of this patent is extended or adjusted under 35 U.S.C. 154(b) by 31 days.

(21) Appl. No.: 15/990,856

(22) Filed: May 29, 2018

(65) Prior Publication Data

US 2018/0277918 A1 Sep. 27, 2018

Related U.S. Application Data

(63) Continuation of application No. PCT/KR2016/012754, filed on Nov. 7, 2016.

(30) Foreign Application Priority Data

Nov. 30, 2015 (KR) ..... 10-2015-0168430

(51) Int. Cl.

| | |
|---|---|
| ***H01P 5/00*** | (2006.01) |
| ***H01P 7/04*** | (2006.01) |
| ***H01P 1/208*** | (2006.01) |
| ***H01P 5/02*** | (2006.01) |
| ***H01P 1/207*** | (2006.01) |
| ***H01P 1/205*** | (2006.01) |
| ***H01P 7/06*** | (2006.01) |

(52) U.S. Cl.

CPC ..... *H01P 5/024* (2013.01); *H01P 1/207* (2013.01); *H01P 1/2053* (2013.01); *H01P 1/2084* (2013.01); *H01P 7/06* (2013.01)

(58) Field of Classification Search

CPC ..... H01P 7/06; H01P 1/2084; H01P 5/024
USPC ..... 333/207–209, 212
See application file for complete search history.

(56) References Cited

U.S. PATENT DOCUMENTS 4,268,809 A * 5/1981 Makimoto ..... H01P 1/2053 333/202
6,342,825 B2 1/2002 Hershtig
(Continued)

FOREIGN PATENT DOCUMENTS

CN 202797211 U 3/2013
DE 2218277 A1 10/1973
(Continued)

OTHER PUBLICATIONS

International Search Report for PCT/KR2016/012754, dated Feb. 15, 2017 and its English translation.

*Primary Examiner* — Rakesh B Patel

(57) ABSTRACT

The present invention relates to a cavity type wireless frequency filter having a cross-coupling notch structure, the filter comprising a notch substrate provided for cross-coupling between at least two resonance elements among a plurality of resonance elements, wherein the notch substrate comprises: a main substrate, which is made of a non-conductive material and has the first and second coupling structures mechanically coupled with at least two resonance elements, respectively; and a conductive line which is implemented by a conductive pattern formed on the main substrate and transfers a signal of a first resonance element to a second resonance element by using a non-contact coupling method.

20 Claims, 15 Drawing Sheets

(56) References Cited

U.S. PATENT DOCUMENTS

| | | | |
|---|---|---|---|
| 6,559,740 | B1 | 5/2003 | Schulz et al. |
| 6,836,198 | B2 | 12/2004 | Engst |
| 2015/0042413 | A1 | 2/2015 | Zhou |
| 2015/0091672 | A1 | 4/2015 | Subedi et al. |

FOREIGN PATENT DOCUMENTS

| | | | |
|---|---|---|---|
| KR | 10-2004-0100084 | A | 5/2005 |
| KR | 10-2009-0035342 | A | 4/2009 |
| KR | 10-1026416 | B | 3/2011 |
| KR | 10-1028459 | B | 4/2011 |
| KR | 10-2012-0129248 | A | 11/2012 |
| KR | 10-2014-0026235 | A | 3/2014 |
| KR | 10-1420044 | B | 7/2014 |
| KR | 20-2014-0004340 | U | 7/2014 |
| KR | 10-2015-0118768 | A | 10/2015 |

* cited by examiner

CAVITY TYPE WIRELESS FREQUENCY FILTER HAVING CROSS-COUPLING NOTCH STRUCTURE

CROSS-REFERENCE TO RELATED APPLICATIONS

This application is a Continuation of International Application No. PCT/KR2016/012754, filed on Nov. 7, 2016, which claims the benefit of and priority to Korean Patent Application No. 10-2015-0168430, filed on Nov. 30, 2015, the content of which are herein incorporated by reference in their entirety.

TECHNICAL FIELD

The present invention relates to a wireless frequency filter used in a wireless communication system, and more particularly, to a cavity type wireless frequency filter having a cross-coupling notch structure.

BACKGROUND ART

Generally, a cavity type wireless frequency filter (hereinafter abbreviated as a "filter") has an accommodation space of a rectangular parallelepiped shape or the like through a metal housing, that is, a plurality of cavities, and for example, a dielectric resonant (DR) element or a resonant element made of a metal resonant rod is provided inside each of the plurality of cavities and thus a high-frequency resonance is generated. In some cases, a structure for generating a resonance with a shape of a cavity without having a DR element may be employed. Further, such a cavity type wireless frequency filter generally includes a cover for blocking an open surface of a corresponding cavity provided at an upper portion of a cavity structure, and as a tuning structure for tuning a filtering characteristic of the corresponding wireless frequency filter, a plurality of tuning screws and nuts for fixing the tuning screws may be installed at the cover. An example of a cavity type wireless frequency filter is disclosed in Korean Patent Laid-Open Application No. 10-2004-100084 (entitled "Radio Frequency Filter," filed on Dec. 2, 2004, and Inventors: Park Jong-Kyu and two others) filed by the present Applicant.

Such a cavity type wireless frequency filter is used to process a transmission and reception radio signal in a wireless communication system, and specifically, the cavity type wireless frequency filter is typically applied to a base station or a repeater in a mobile communication system.

Recently, as a required data processing capacity increases in a mobile communication system, a proposal for installing a large number of small (or micro) base stations has been suggested so as to resolve a rapid increase of wireless data traffic. Further, technological development for weight reduction and miniaturization of equipment for processing wireless signals and installed in a base station is continuously underway. Particularly, since the cavity type filter requires a relatively large size due to a characteristic of a structure having a cavity, reduction in size and weight of such a cavity type filter has become a major consideration.

Meanwhile, important characteristics of the wireless frequency filter are an insertion loss and a skirt characteristic. The insertion loss refers to power which is lost while a signal passes through a filter, and the skirt characteristic refers to steepness of a pass band and a stop band of the filter. The insertion loss and the skirt characteristics have a tradeoff relationship with each other according to the number of stages (orders) of the filter. As the number of stages of the filter is increased, the skirt characteristic becomes better but the insertion loss becomes lower.

A method of forming a notch (an attenuation pole) is mainly used to improve a skirt characteristic of a filter without increasing the number of stages of the filter. A most common method for forming a notch is a cross-coupling method.

Generally, a notch structure of the cross-coupling method is mainly configured with a metal workpiece such as a metal rod which forms a capacitance coupling between resonant elements of two cavities which are not continuous in a circuit. The metal rod is installed to pass through an inner wall for separating the two cavities. At this point, in order to electrically isolate the metal rod from the inner wall, an outer portion of the metal rod is surrounded a support of a dielectric material (not shown) such as Teflon, and then is coupled to the inner wall. At this point, a portion at which the metal rod is installed at the inner wall may be formed with a through-hole structure. However, since a process for forming a through-hole at the inner wall is not easy, a portion of an upper end of the inner wall is generally cut and then a metal rod surrounded with the support is installed at the corresponding cut portion. The support serves as insulation of the metal rod as well as has a shape engaged with a shape of the cut portion of the inner wall and is fixed to a portion at which the metal rod is installed, such that the metal rod is fixedly supported.

U.S. Pat. No. 6,342,825 of K & L Microwave Co., (entitled "Bandpass Filter Having Tri-section," Inventor: Rafi Hershtig, and Patented Date: Jan. 29, 2002), or U.S. Pat. No. 6,836,198 of RADIO FREQUENCY SYSTEMS (entitled "Adjustable Capacitive Coupling Structure," Inventor: Bill Engst, and Patented date: Dec. 28, 2004) discloses an example of a technique for forming a notch using a cross-coupling method.

A notch structure using such a cross-coupling method may be almost indispensably applied to implementing a small or micro cavity type filter applied to a small or micro base station. At this point, due to space and size limitations resulting from a characteristic of the small filter, a distance between resonant elements and a metal rod should be designed to be very close so as to obtain a desired coupling amount in the notch structure using the cross-coupling method. However, it is very difficult to precisely implement a distance between the resonant elements and the metal rod to correspond to a required coupling amount with a tolerance in the range of, i.e., about ±0.03 to 0.05 mm, which is commonly used in metal processing, and thus deviation in cross-coupling amount between products becomes larger.

Accordingly, in the cross-coupling type notch structure applied to a small or micro filter, when implementing a designed structure as an actual product, it is required a very high processing accuracy when a cross-coupling type metal rod (and resonant elements) are manufactured and installed. For example, a machining tolerance of about 0.01 mm or less may be required in a gap between a metal rod and resonant elements. However, when a very precise machining tolerance is required, difficulty in machining operation is increased and a machining time is increased, and thus machining costs are increased and a production yield is lowered, such that there is a difficulty in mass production.

DISCLOSURE

Technical Problem

Accordingly, it is an objective of some embodiments of the present invention to provide a cavity type wireless frequency filter having a cross-coupling notch structure capable of being reduced in size and weight.

Another objective according to some embodiments of the present invention is to provide a cavity type wireless frequency filter having a cross-coupling notch structure capable of providing a stable notch characteristic since it has a simpler structure, is easier to manufacture, and has a stable structure.

Technical Solution

According to one aspect of the present invention, there is provided a cavity type wireless frequency filter having a cross-coupling notch structure, the filter including a housing having a hollow therein to provide a plurality of cavities and an open surface at one side of the housing, a cover for blocking the open surface of the housing, a plurality of resonant elements disposed in the hollow of the housing, and a notch substrate installed for cross-coupling between at least two resonant elements among the plurality of resonant elements, wherein the notch substrate includes a main substrate made of a non-conductive material and having a first coupling structure and a second coupling structure which are mechanically coupled to the at least two resonant elements, and a conductive line implemented with a conductor pattern formed on the main substrate and transmitting a signal of a first resonant element among the at least two resonant elements to a second resonant element thereamong through a non-contact coupling method.

The conductive line may include a first sub conductor pattern electrically connected to a support of the first resonant element in the first coupling structure of the main substrate, and a second sub conductor pattern electrically connected to a support of the second resonant element in the second coupling structure of the main substrate.

The first coupling structure and the second coupling structure may form through-holes which are fitted into and mechanically coupled to the supports of the at least two resonant elements.

A notch tuning pin for tuning a notch characteristic may be coupled to a portion of the cover corresponding to the notch substrate through a notch tuning through-hole, and a notch tuning hole structure for forming a through-hole having a size corresponding to a lower end portion of the notch tuning pin may be formed at a portion of the main substrate of the notch substrate, which corresponds to the notch tuning pin.

A conductive metal film may be formed on an inner surface of each of the through-holes of the first and second coupling structures of the main substrate.

The first sub conductor pattern and the second sub conductor pattern may be formed on different surfaces of the main substrate, a first end of the first sub conductor pattern may be configured to be connected to the inner surface of the through-hole of the first coupling structure, and a first end of the second sub conductor pattern may be configured to be connected to the inner surface of the through-hole of the second coupling structure.

The first sub conductor pattern and/or the first end of the second sub conductor pattern may be formed to surround at least a portion of a region forming the through-hole of the first coupling structure and to maintain a separation distance from the through-hole of the first coupling structure.

The second end of the first sub conductor pattern and the second end of the second sub conductor pattern may be configured to mutually transmit signals through a non-contact coupling method or may be configured to be directly connected to each other.

The notch substrate may have a structure for cross-coupling with a third resonant element, a first resonant element, and a second resonant element among the plurality of resonant elements, the main substrate of the notch substrate may have a third coupling structure which is fitted into and mechanically coupled to a third resonant element among the plurality of resonant elements, and the conductive line may include a conductive line for transmitting a signal of the first resonant element or the second resonant element to the third resonant element through a non-contact coupling method.

Advantageous Effects

As described above, the cavity type wireless frequency filter having a notch structure according to the embodiments of the present invention provides a notch structure capable of being further reduced in size and weight, and particularly, the notch structure can have a simpler structure, can be easier to manufacture, and can have a stable structure, thereby providing a stable notch characteristic.

BEST MODE

Hereinafter, preferred embodiments of the present invention will be described in detail with reference to the accompanying drawings.

Figure 1:
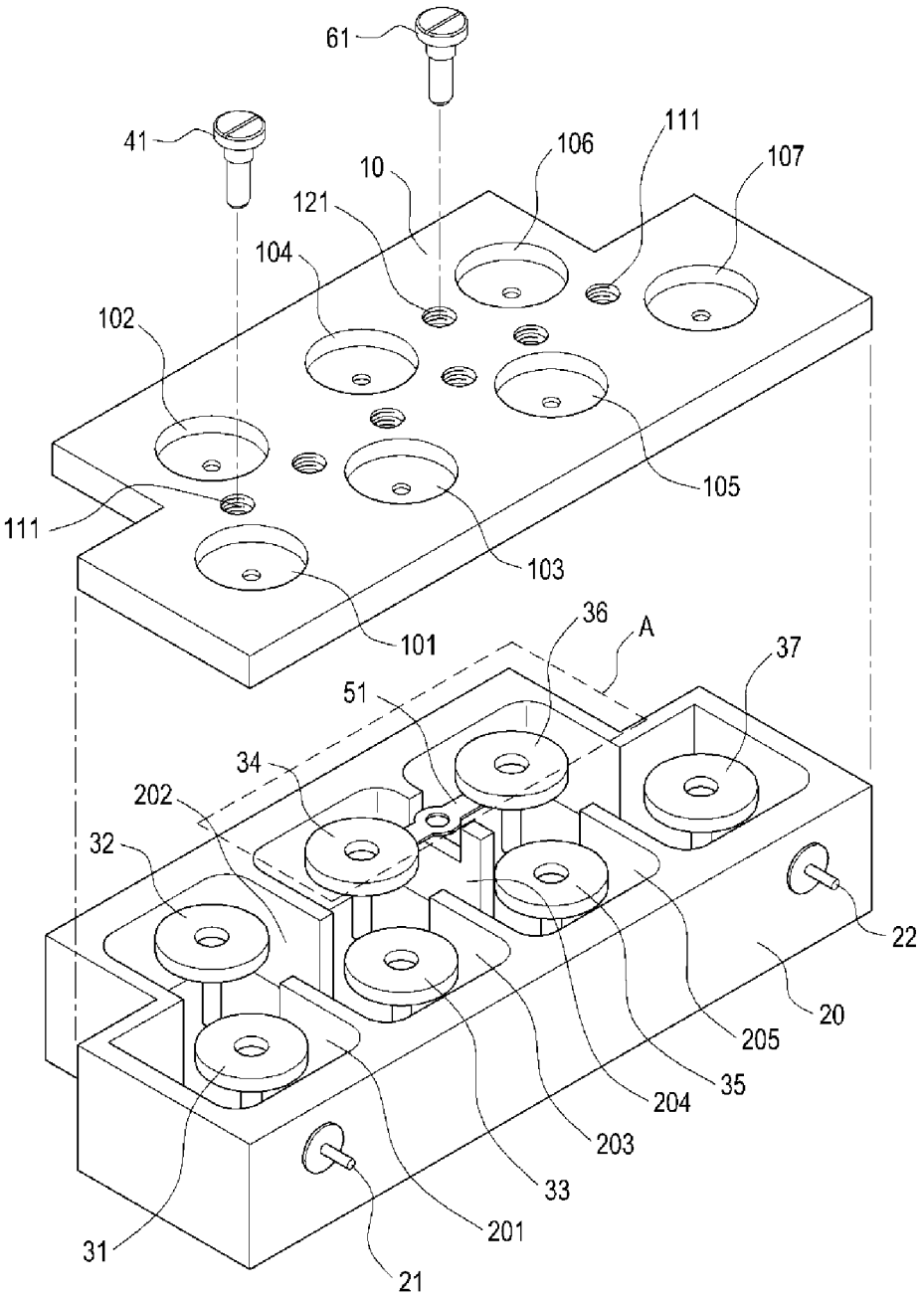
FIG. 1 is a partially separated perspective view of a cavity type wireless frequency filter having a cross-coupling notch structure according to a first embodiment of the present invention.

FIG. 1 is a partially separated perspective view of a cavity type wireless frequency filter having a cross-coupling notch structure according to a first embodiment of the present invention. Referring to FIG. 1, the cavity type wireless frequency filter having the notch structure according to the first embodiment of the present invention includes an enclosure having a plurality of cavities (seven cavities in examples of FIGS. 1 and 5), each of which includes a hollow therein and is blocked from the outside. The enclosure forms seven cavities and is formed to include a housing 20 having one open surface (e.g., an upper surface) and a cover 10 for blocking the open surface of the housing 20. The cover 10 and the housing 20 may have a structure which is coupled by laser welding or soldering, and in addition to laser welding or soldering, the cover 10 and the housing 20 may be coupled by a screw connection method through a fixing screw (not shown).

The housing 20 and the cover 10 may be made of a material such as aluminum (alloy) or the like and may be plated with a silver or copper material on at least a surface forming the cavity to improve electrical characteristics. Resonant elements may also be made of a material such as aluminum (alloy) or iron (alloy) and may be plated with a silver or copper material.

For example, FIG. 1 illustrates an example in which seven cavity structures are connected in multiple stages within the housing 20. That is, it can be seen that the seven cavity structures are sequentially connected. Each cavity of the housing 20 has a resonant element 31, 32, 33, 34, 35, 36, or 37 at a central position of each cavity. Further, a coupling window having a connecting path structure is formed between the cavity structures, which are sequentially connected to each other, so as to allow each cavity structure in the housing 20 to have a sequential coupling structure. The coupling window may be formed at a portion corresponding to each of partition walls 201, 202, 203, 204, and 205 between the cavity structures in a shape in which a predetermined portion is removed in a predetermined size.

In the structure shown in FIG. 1, at least some of the resonant elements 31, 32, 33, 34, 34, 35, 36, and 37 may have the same structure, and for convenience of description, all the resonant elements are shown to have the same structure in the example of FIG. 1. For example, each of the first to seventh resonant elements 31 to 37 may be configured with a flat plate portion having a circular flat plate shape and a support for fixing and supporting the flat plate portion, and the support is fixedly installed at an inner bottom surface of a corresponding cavity, that is, the housing 20. More detailed structures of the flat plate portion and the support in each of the resonant elements 31 to 37 may have various structures according to a design condition of a corresponding filter, and resonant elements of different detailed structures may be mixed to constitute a filter.

First to seventh recessed structures 101, 102, 103, 104, 105, 106, and 107 for frequency tuning may be formed at the cover 10 by corresponding to the resonant elements 31 to 37 of the cavity structures. Further, a plurality of coupling tuning screw holes 111 may be formed at portions of the cover 10 corresponding to the coupling windows, which are the connecting path structures of the cavity structures in the housing 20. A coupling tuning screw 41 for coupling tuning may be inserted into each of the plurality of coupling tuning screw holes 111 with a proper depth to perform a coupling tuning operation. At this point, the coupling tuning screw 41 may be additionally fixed using a separate adhesive such as an epoxy resin or the like.

Further, an input terminal 21 and an output terminal 22 of a corresponding wireless frequency filter may be installed through a through-hole or the like which may be formed at one side of the housing 20. FIG. 1 illustrates an example of a state in which the input terminal 21 and the first resonant element 31 are coupled, and the output terminal 22 is connected to the seventh resonant element 37. For example, an extension line (not shown) of the input terminal 21 and the support of the first resonant element 31 may be directly coupled or may be connected through a non-contact coupling method.

In the described above, the structure of the cover 10 may have a structure similar to that applied to a wireless frequency filter having a conventional cavity structure, and for example, the structure of the cover 10 may have a structure similar to that disclosed in Korean Patent Laid-Open Application No. 10-2014-0026235 (entitled "Wireless Frequency Filter having Cavity Structure," Published Date: Mar. 5, 2014, and Inventors: Park, Nam Shin and two others). Korean Patent Laid-Open Application No. 10-2014-0026235 proposes a simplified filter structure capable of performing frequency tuning without employing a tuning screw and an engagement structure of a fixing nut, which are a more general structure. As disclosed in Korean Patent Laid-Open Application No. 10-2014-0026235, the cover 10 according to the embodiments of the present invention may include one or more recessed structures 101 to 107 are formed at positions corresponding to the resonant elements 31 to 37. A plurality of dot peen structures are formed at the recessed structures 101 to 107 by marking or pressing using an embossed pin of external marking equipment, thereby enabling frequency tuning.

Meanwhile, in some other embodiments of the present invention, a more generalized frequency tuning method may be applied to the cover 10, and thus a frequency tuning screw and a fixing nut may be provided without forming recessed structures 101 to 107. However, the structure including the frequency tuning screw and the fixing nut may have a more complicated structure and may be difficult to be miniaturized.

Looking at the above-described structures, the cavity structures formed at the housing 20 and the cover 10 in the wireless frequency filter according to the first embodiment of the present invention and the structures of the resonant elements 31 to 37 inside the cavities are similar to a conventional structure except that the structures according to the present invention may be implemented in a size that is smaller than the conventional structure. However, a notch structure and an installation structure thereof according to the embodiments of the present invention have improved structures compared with a conventional notch structure and a conventional installation structure thereof.

FIG. 1 illustrates a notch structure according to the first embodiment of the present invention and an example in which a notch substrate 51 is installed for a cross-coupling between the fourth resonant element 34 and the sixth resonant element 36. At this point, a window having a shape from which an appropriate portion is removed to allow a notch substrate 51 to be installed is formed at the partition wall 204 for separating the cavity of the fourth resonant element 34 from that of the sixth resonant element 36. Further, a notch tuning through-hole 121 coupled to a notch tuning pin 61 is formed at the cover 10 to tune a notch characteristic of a portion corresponding to the notch substrate 51. The notch tuning pin 61 which is set to an appropriate length for notch tuning may be inserted into the notch tuning through-hole 121 and be interlocked with the notch substrate 51 to perform a tuning operation of the notch characteristic. At this point, the notch tuning pin 61 may be generally formed in a screw shape and may have a structure which is coupled to the notch tuning through-hole 121 through a screw coupling. The notch tuning pin 61 may be made of a conductive metal material such as aluminum (alloy) or brass (alloy), and silver may be plated on the notch tuning pin 61.

Figure 2:
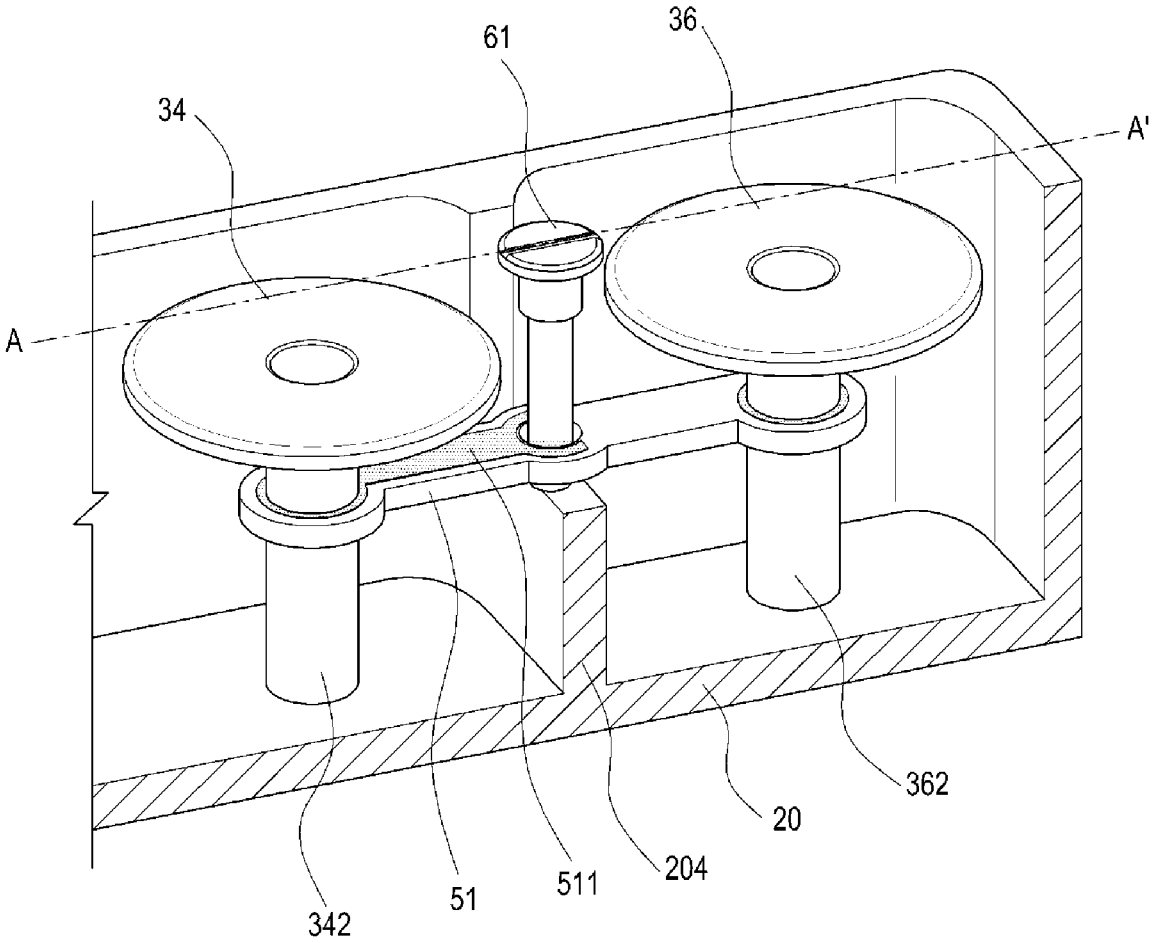
FIG. 2 is a cross-sectional view of Part A of the wireless frequency filter FIG. 1.
Figure 3A:
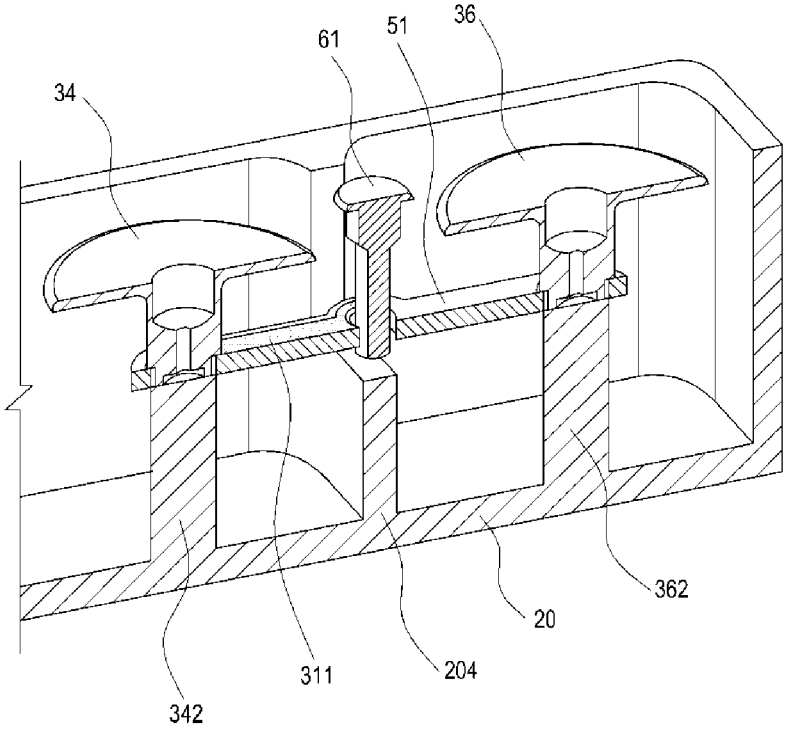
FIGS. 3A and 3B are cross-sectional views taken along the line A-A' of FIG. 2.
Figure 3B:
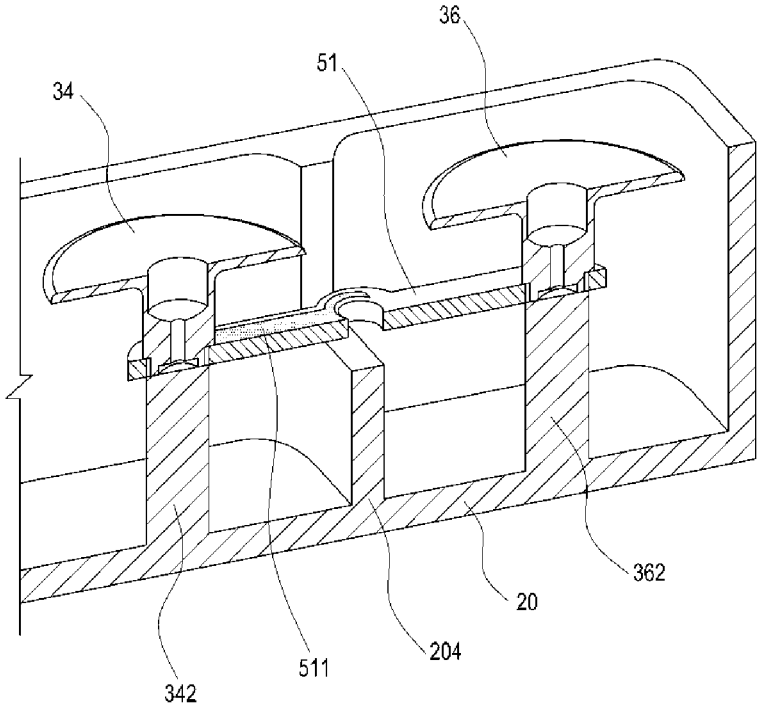
Figure 4A:
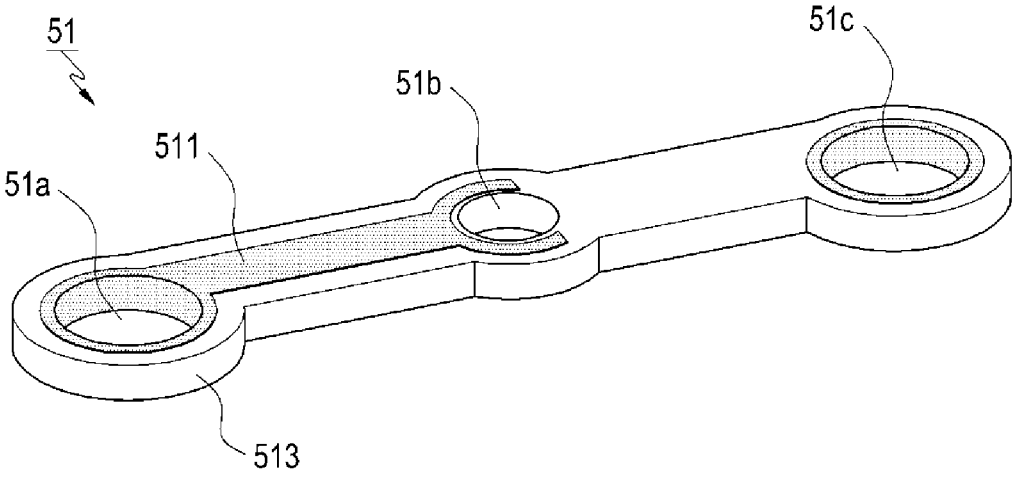
FIGS. 4A and 4B are detailed perspective views of a notch substrate of FIG. 1.
Figure 4B:
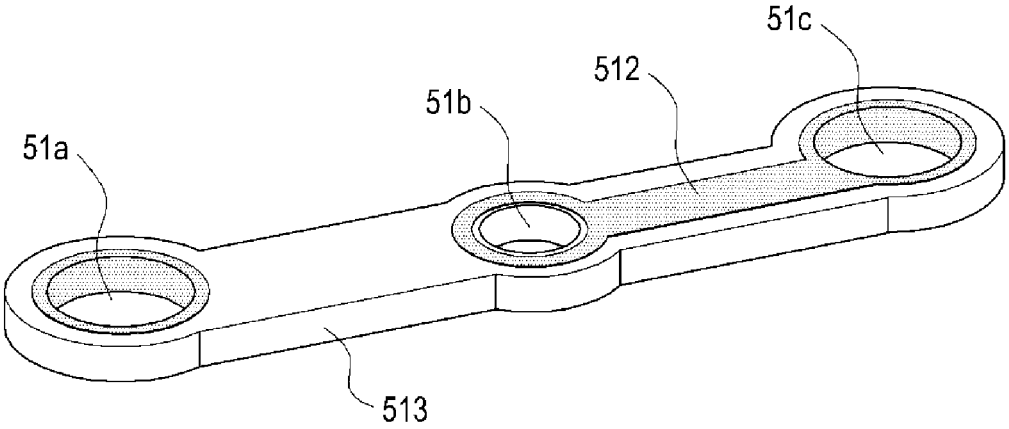

FIG. 2 is a cross-sectional view of Part A of the wireless frequency filter FIG. 1, which is indicated by a dotted-line rectangular box and includes the notch substrate 51 and illustrates relating portions such as the fourth resonant element 34, the sixth resonant element 36, and the notch tuning pin 61 in detail. FIGS. 3A and 3B are partially cross-sectional views taken along the line A-A' of FIG. 2, FIG. 3A illustrates a structure including the notch tuning pin 61, and FIG. 3B illustrates a structure not including the notch tuning pin 61. FIGS. 4A and 4B are detailed perspective views of the notch substrate 51 of FIG. 1, FIG. 4A is a perspective view of the notch substrate 51 when viewed from a first side (e.g., an upper side), and FIG. 4B is a perspective view of the notch substrate 51 when viewed from a second side (e.g., a lower side).

Describing a configuration of the notch substrate 51 according to the first embodiment of the present invention in detail with reference to FIGS. 2 to 4B, the notch substrate 51 may generally have a printed circuit board (PCB) structure, and according to some embodiments of the present invention, the notch substrate 51 may include a main substrate 513 made of a non-conductive material such as Teflon or the like, and conductive lines 511 and 512 formed at a first surface (e.g., an upper surface) and/or a second surface (e.g., a lower surface) of the main substrate 513, which is formed using, e.g., a conductive pattern forming process during a PCB substrate manufacturing process. Similar to a general PCB substrate, the main substrate 513 may be implemented with a single-layer or multilayered substrate of a frame retardant (FR) line or a composite epoxy material (CEM) line.

The main substrate 513 has at least two resonant elements, and in the example of FIGS. 2 to 4B, a coupling structure mechanically coupled to the fourth resonant element 34 and the sixth resonant element 36 and fixedly supporting the main substrate 513, that is, a first coupling structure 51*a* and a second coupling structure 51*c* in the form of, e.g., a ring are provided to form through-holes. A support 342 of the fourth resonant element 34 is fitted into and coupled to the through-hole of the first coupling structure 51*a*, and a support 362 of the sixth resonant element 36 is fitted into and coupled to the through-hole of the second coupling structure 51*c*.

In the example of FIGS. 2 to 4B, the conductive lines 511 and 512 are electrically connected to at least two resonant elements, that is, the fourth resonant element 34 and the sixth resonant element 36, and the conductive lines 511 and 512 are implemented as conductor patterns formed on the upper surface and/or the lower surface of the main substrate 513 so as to transmit a signal of at least one resonant element to another resonant element using a non-contact coupling method. For example, the conductive lines 511 and 512 may be configured with a first sub conductor pattern 511 formed on the upper surface of the main substrate 513 and electrically connected to the support 342 of the fourth resonant element 34, and a second sub conductor pattern 512 formed on the lower surface of the main substrate 513 and electrically connected to the support 362 of the sixth resonant element 36, and the first sub conductor pattern 511 and the second sub conductor pattern 512 are configured to transmit signals through a non-contact coupling method.

Describing the foregoing in more detail, similar to a structure of a via hole generally formed on a PCB substrate, an inner surface of the through-hole of the first coupling structure 51*a* of the main substrate 513 may be configured to allow a conductive metal film to be formed thereon, and one end (a first end) of the first sub conductor pattern 511 may be configured in the form of being connected to the inner surface of the through-hole of the first coupling structure 51*a*. Similarly, a conductive metal film may also be formed on an inner surface of the through-hole of the second coupling structure 51*c*, and one end (a first end) of the second sub conductor pattern 512 may be configured in the form of being connected to the inner surface of the through-hole of the second coupling structure 51*c*. For example, mutually facing portions between the other end (a second end) of the first sub conductor pattern 511 and the other end (a second end) of the second sub conductor pattern 512 is formed at a central position of the main substrate 513 with a predetermined length by interposing the main substrate 513 to transmit a signal in a non-contact coupling method.

A tuning hole structure 51*b* may further be provided at the main substrate 513 to form a through-hole having a size corresponding to a lower end portion of the notch tuning pin 61 so as to allow the lower end portion of the notch tuning pin 61 to be installed in an insertable form at a portion corresponding to a lower end portion of a body of the notch tuning pin 61. The tuning hole structure 51*b* of the main substrate 513 may be formed at a central position of the main substrate 513. At this point, the mutually facing portions between the first sub conductor pattern 511 and the second sub conductor pattern 512 may be appropriately formed on the upper and lower surfaces of the main substrate 513 in a peripheral region of the tuning hole structure 51*b*. This structure is a structure in which the notch tuning pin 61 for notch tuning is installed at a position at which the first sub conductor pattern 511 and the second sub conductor pattern 512 are non-contact coupled to each other, so that tuning for the notch characteristic may be more effectively performed at a corresponding position.

In the notch substrate 51 having the above-described structure, the supports 342 and 362 of the fourth resonant element 34 and the sixth resonant element 36 are respectively inserted into the through-holes formed at the first coupling structure 51*a* and the second coupling structure 51*c* of the main substrate 513 and are respectively coupled to the first coupling structure 51*a* and the second coupling structure 51*c* thereof, and then soldering may further be performed at the corresponding coupling portions. Consequently, the corresponding coupling portions are mechanically and electrically coupled with more stability such that the notch substrate 51 is fixedly installed. After the notch substrate 51 is fixedly installed, the notch tuning pin 61 is coupled to the notch tuning through-hole 121 of the cover 10 as shown in FIG. 1, and thus the lower end portion of the notch tuning pin 61 is installed to be insertable into the tuning hole structure 51*b* formed at the notch substrate 51.

A degree of coupling between the notch tuning pin 61 and a portion of a signal transmitted through the notch substrate 51 may be controlled by adjusting a degree of proximity between the lower end portion of the notch tuning pin 61 and the notch substrate 51 and a degree of insertion of the notch tuning pin 61 into the tuning hole structure 51*b*, and thus a notch characteristic generated by the notch substrate 51 may be appropriately adjusted. At this point, when the notch tuning pin 61 is formed in a screw structure and is screw-coupled to the notch tuning through-hole 121 of the cover 10, a screw coupling of the notch tuning pin 61 may be tightened or released to adjust a distance between the notch tuning pin 61 and the notch substrate 51. Alternatively, the distance between the notch tuning pin 61 and the notch substrate 51 may be adjusted by replacing and installing a notch tuning pin 61 designed to have an appropriate different length or by appropriately cutting a length of the lower end portion of the notch tuning pin 61 and reinstalling the notch tuning pin 61 having the cut length.

As shown in FIGS. 1 to 4A, the notch substrate 51 applied to the wireless frequency filter according to the first embodiment of the present invention may be configured and installed, and the notch substrate 51 basically has a structure in which a conductor pattern for signal transmission is formed on a substrate similar to a PCB substrate, so that a manufacturing process may be simplified and the notch substrate 51 may be accurately implemented compared with a conventional notch structure using a metal bar or the like. Particularly, the notch substrate 51 may be simply installed by fitting two resonant elements which will be cross-coupled, e.g., the supports 342 and 362 of the fourth and sixth resonant elements 34 and 36, into the first and second coupling structures 51*a* and 51*c* forming the through-holes of the notch substrate 51, such that the notch substrate 51 may be easily installed while problems due to a conventional machining tolerance and a conventional assembly tolerance may be resolved.

Figure 5A:
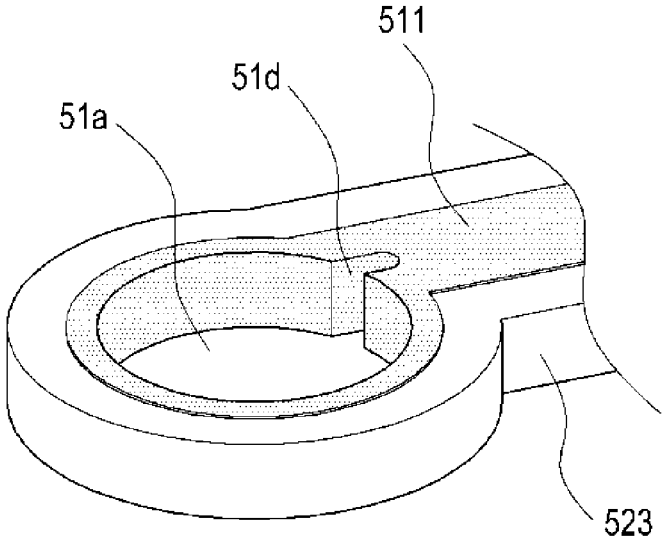
FIGS. 5A and 5B are perspective views of some modifications of the notch substrate of FIG. 1.

Meanwhile, the notch substrate 51 according to the first embodiment of the present invention shown in FIGS. 1 to 4A (and notch substrates according to other embodiments of the present invention, which will be described below) may be variously modified or altered in detailed features in form and size of the main substrate 513 or the conductive lines 511 and 512. For example, in one modification of the notch substrate 51 as shown in FIG. 5A, a solder injection recess 51*d* is additionally formed at an appropriate portion of the first coupling structure 51*a* forming the through-hole. The solder injection recess 51*d* facilitates solder injection and application during soldering of the first coupling structure 51*a* with a support of a resonant element coupled thereto. Alternatively, such a solder injection recess 51*d* may also be formed at the second coupling structure 51*c* of the notch substrate 51.

Figure 5B:
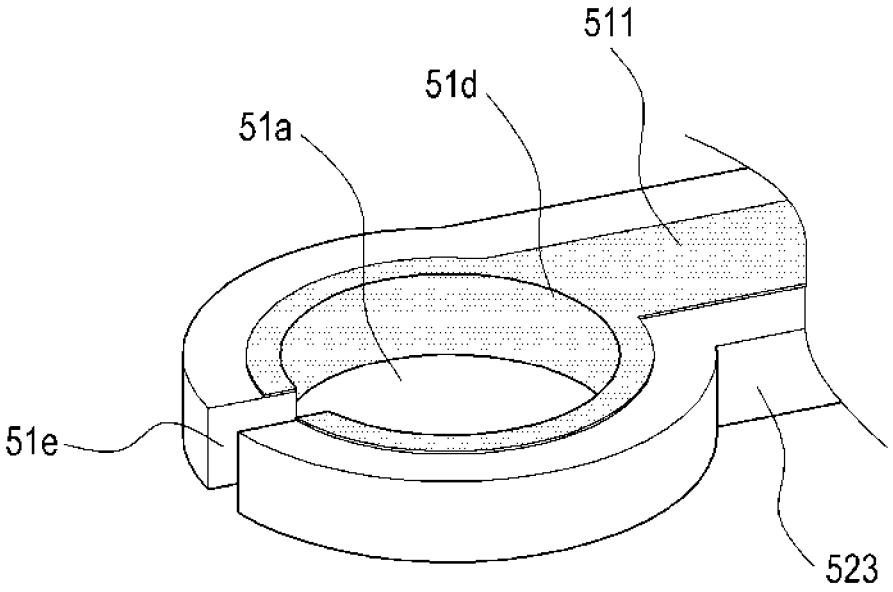

In another modification of the notch substrate 51 shown in FIG. 5B, an incised portion 51*e* is formed such that a portion of the first coupling structure 51*a* forming the through-hole is incised. As described above, the first coupling structure 51*a* and/or the second coupling structure 51*c* of the notch substrate 51 may be formed in a complete ring shape without having a discontinuous portion but may also be formed in a ring shape of which a portion is partially incised.

Figure 6:
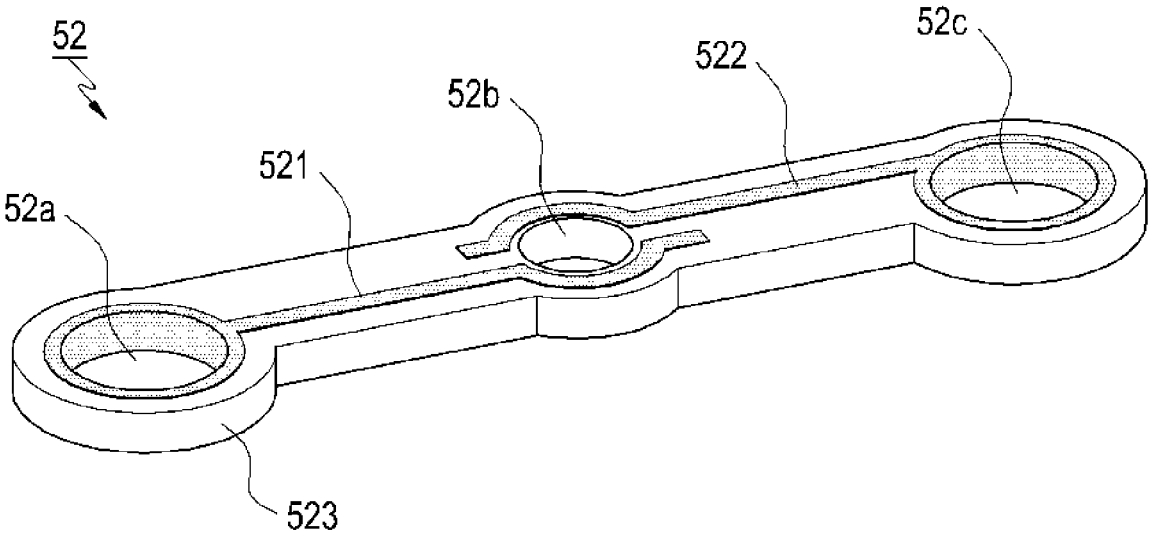
FIG. 6 is a perspective view of a notch substrate which is applicable to a cavity type wireless frequency filter having a cross-coupling notch structure according to a second embodiment of the present invention.

FIG. 6 is a perspective view of a notch substrate 52 which is applicable to a cavity type wireless frequency filter having a cross-coupling notch structure according to a second embodiment of the present invention. Referring to FIG. 6, similar to the structure of the first embodiment shown in FIGS. 2 to 4B, the notch substrate 52 according to the second embodiment of the present invention includes the main substrate 523 having a first coupling structure 52*a* and a second coupling structure 52*a*, which form through-holes, and conductive lines 521 and 522 formed on the main substrate 523.

Unlike the first embodiment, in the notch substrate 52 shown in FIG. 6, the conductive lines 521 and 522 are formed on the same surface of the main substrate 523. For example, the conductive lines 521 and 522 includes a first sub conductor pattern 521 formed such that one end (a first end) thereof is in electrical contact with a metal film formed in a region of a through-hole of the first coupling structure 52*a* of the main substrate 523, and a second sub conductor pattern 522 formed such that one end (a first end) thereof is in electrical contact with a metal film formed in a region of a through-hole of the second coupling structure 52*c* of the main substrate 523, and the first and second sub conductor patterns 521 and 522 may be formed on an upper surface of the main substrate 523. Further, mutually facing portions between the other end (a second end) of the first sub conductor pattern 521 and the other end (a second end) of the second sub conductor pattern 522 is formed at a central position of the main substrate 513 with a predetermined length to transmit a signal through a non-contact coupling method.

As in the structure of the first embodiment, a tuning hole structure 52*b* may be formed at a central position of the main substrate 523, and a portion of the other end (the second end) of the first sub conductor pattern 521 and a portion of the other end (the second end) of the second sub conductor pattern 522 may be formed to surround the tuning hole structure 52*b*.

Figure 7A:
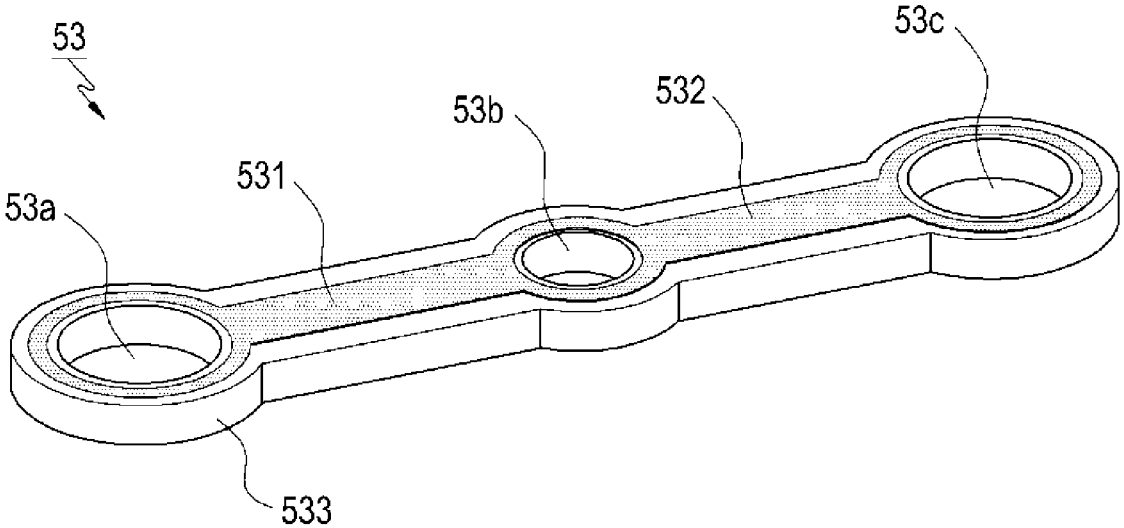
FIGS. 7A and 7B are configurational diagrams of a notch substrate which is applicable to a cavity type wireless frequency filter having a cross-coupling notch structure according to a third embodiment of the present invention.
Figure 7B:
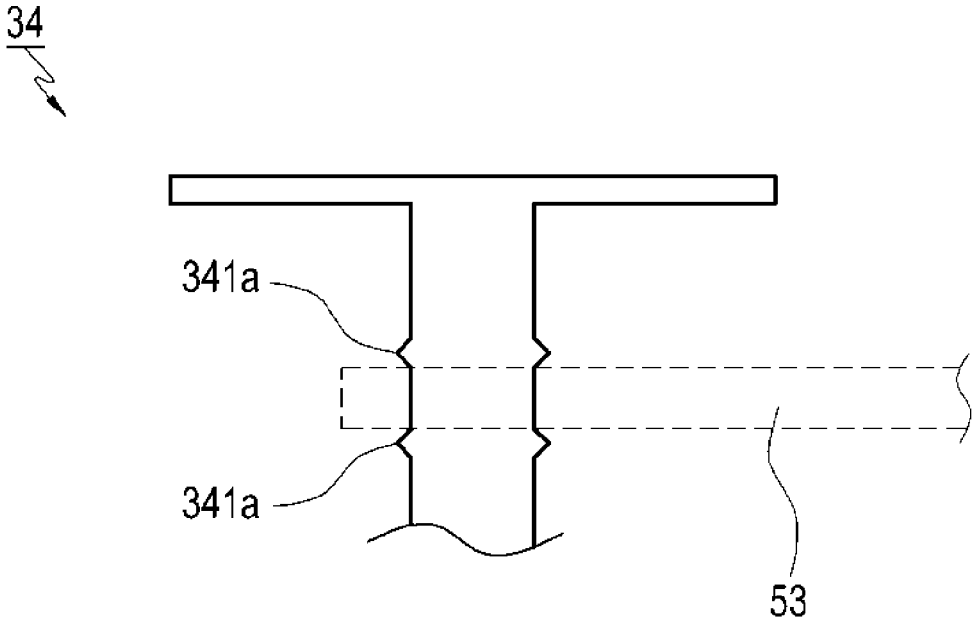

FIGS. 7A and 7B are configurational diagrams of a notch substrate 53 which is applicable to a cavity type wireless frequency filter having a cross-coupling notch structure according to a third embodiment of the present invention, FIG. 7A is a perspective view of the notch substrate 53, and FIG. 7B illustrates a portion of a side structure showing an installation state of the notch substrate 53. First, referring to FIG. 7A, similar to the structure of the second embodiment shown in FIG. 6, the notch substrate 53 according to the third embodiment of the present invention includes a main substrate 533 having a first coupling structure 53*a* and a second coupling structure 53*c*, which form through-holes, and conductive lines 531 and 532 formed on the main substrate 533. Further, a first sub conductor pattern 531 and a second sub conductor pattern 532, which constitute the conductive lines 531 and 532, are formed on the same surface of the main substrate 533.

However, in the notch substrate 53 shown in FIG. 7A, the first coupling structure 53*a* and the second coupling structure 53*c* of the main substrate 533 form through-holes for coupling to supports of resonant elements, but unlike the second embodiment shown in FIG. 6, a metal film is not formed. At this point, one end (a first end) of the first sub conductor pattern 531 is formed to surround at least a portion of a region forming the through-hole of the first coupling structure 53*a* (an entire region in the example of FIG. 7A) on an upper surface of the main substrate 533. In this case, the portion surrounding the corresponding through-hole in the first sub conductor pattern 531 is formed to be in indirect contact with a support of a resonant element coupled to the corresponding through-hole and to maintain a separation distance from the corresponding through-hole so as to receive a signal through a non-contact coupling method. Similarly, one end (a first end) of the second sub conductor pattern 532 is formed to surround at least a portion of a region forming the through-hole of the second coupling structure 53*c* and to maintain a separation distance from the corresponding through-hole on the upper surface of the main substrate 533.

Further, the first sub conductor pattern 531 and the second sub conductor pattern 532 are directly connected and integrally formed instead of being configured to mutually transmit signals through a non-contact coupling method. For example, the other end (a second end) of the first sub-conductor pattern 531 and the other end (a second end) of the second sub-conductor pattern 532 may be formed to surround a tuning hole structure 53*b* formed at a central position of the main substrate 533, and mutually facing portions may be configured to be directly connected to each other.

In the notch substrate 53 according to the third embodiment as shown in FIG. 7A, the supports of the resonant elements are fitted into and coupled to the through-holes formed at the first coupling structure 53*a* and the second coupling structure 53*c*, but the corresponding coupling portions are not soldered. That is, each of the supports of the resonant elements is configured to transmit a signal to the first and second sub conductor patterns 531 and 532 of the notch substrate 53 through the non-contact coupling method. At this point, as shown in FIG. 7B, a hook protrusion 341*a* having an appropriate shape may be formed at the support of the resonant element 34 so as to more stably support the coupled notch substrate 53.

Figure 8:
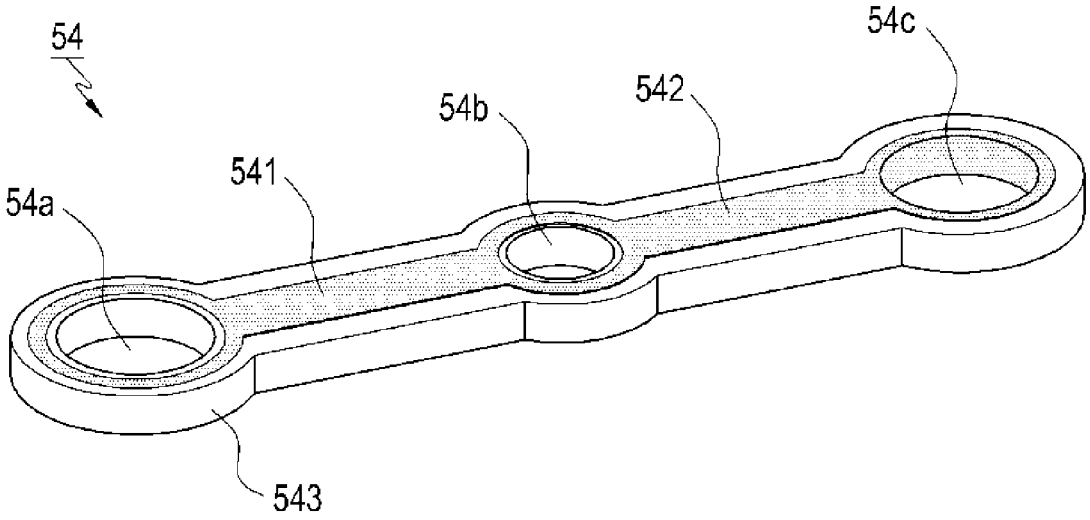
FIG. 8 is a perspective view of a notch substrate which is applicable to a cavity type wireless frequency filter having a cross-coupling notch structure according to a fourth embodiment of the present invention.

FIG. 8 is a perspective view of a notch substrate 54 which is applicable to a cavity type wireless frequency filter having a cross-coupling notch structure according to a fourth embodiment of the present invention. Referring to FIG. 8, largely similar to the structure of the third embodiment shown in FIG. 7, the notch substrate 54 according to the fourth embodiment of the present invention includes a main substrate 543 having a first coupling structure 54*a* and a second coupling structure 54*c*, which form through-holes, and conductive lines 541 and 542 formed on the main substrate 543. Further, a first sub conductor pattern 541 and a second sub conductor pattern 542, which constitute the conductive lines 541 and 542, are formed on the same surface of the main substrate 543. At this point, the first sub conductor pattern 541 and the second sub conductor pattern 542 may be formed to surround a tuning hole structure 54*b* formed at a central position of the main substrate 543, and mutually facing portions may be configured to be directly connected to each other.

As in the structure shown in FIG. 7A, in the notch substrate 54 shown in FIG. 8, the first coupling structure 54*a* and a portion relating thereto in the first sub conductor pattern 541 are configured to be in indirect contact with a coupled support of a resonant element and to receive a signal through a non-contact coupling method, but similar to the embodiments shown in FIGS. 2 to 6, the second coupling structure 54*c* and a portion relating thereto in the second sub-conductor pattern 542 are configured to be indirect contact with a coupled support of a resonant element and to receive a signal.

As shown in FIGS. 2 to 8, in the notch substrate of the present invention, the first and second coupling structures and the coupling structure of the first and second sub conductor patterns may be selectively configured by appropriately mixing with the structures of the various embodiments according to a design condition for a cross-coupling amount or an installation condition. Further, in another embodiment of the present invention, the first and second sub conductor patterns in the structures shown in FIGS. 7A and 8 may be configured to transmit signals through a non-contact coupling method without being directly connected to each other. In this case, the first and second sub conductor patterns may be formed on different surfaces of the main substrate.

Figure 9:
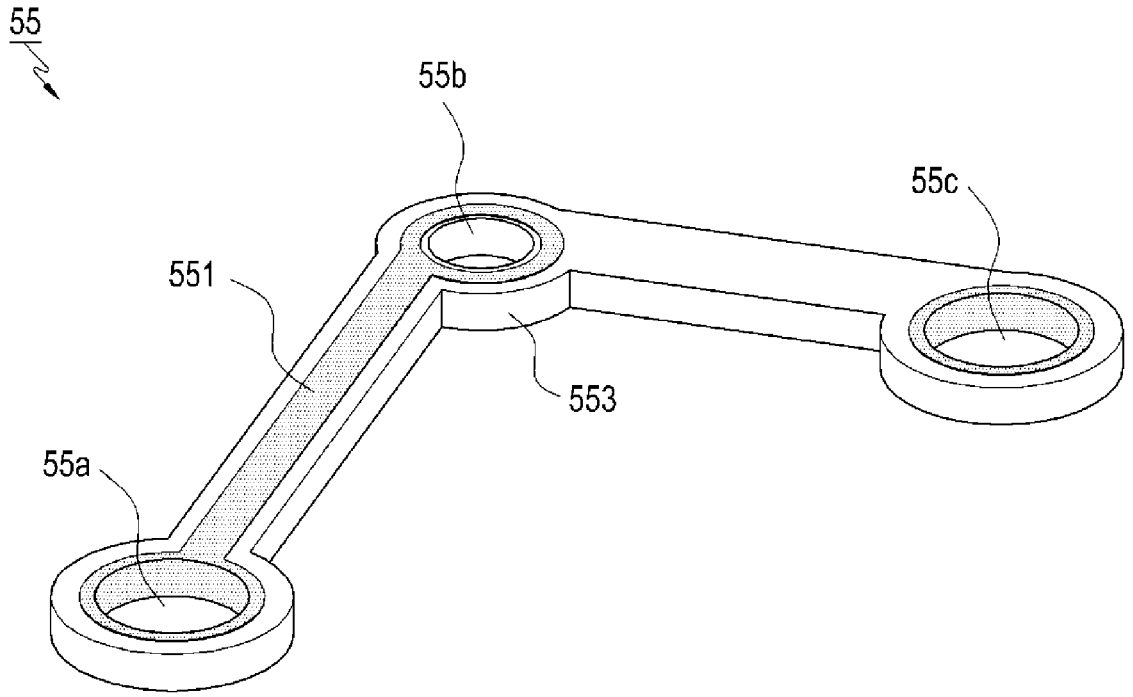
FIG. 9 is a perspective view of a notch substrate which is applicable to a cavity type wireless frequency filter having a cross-coupling notch structure according to a fifth embodiment of the present invention.

FIG. 9 is a perspective view of a notch substrate 55 which is applicable to a cavity type wireless frequency filter having a cross-coupling notch structure according to a fifth embodiment of the present invention. Referring to FIG. 9, similar to the structure of the first embodiment shown in FIGS. 2 to 4B, the notch substrate 55 according to the fifth embodiment of the present invention includes a main substrate 523 having a first coupling structure 55*a* and a second coupling structure 55*c*, which form through-holes, and a tuning hole structure 55*b*. Further, the notch substrate 55 includes conductive lines 551 and 552 configured with a first sub conductor pattern 551 and a second sub conductor pattern 552, which are formed on different surfaces of the main substrate 553 and mutually transmit signals through a non-contact coupling method.

Although the notch substrate 51 of the first embodiment shown in FIGS. 2 to 4B has been entirely formed in a "-" shape, at least a portion of the notch substrate 55 according to the fifth embodiment shown in FIG. 9 is formed to be bent, e.g., to entirely have an "L" shape.

As described above, the notch substrate according to some embodiments of the present invention may be formed in various shapes such as an arc shape, a shape having multiple bent portions according to a design of a corresponding filter. Further, since the notch substrate of the present invention is implemented with a PCB structure even though being manufactured in various shapes described above, the notch substrate may be easily manufactured without requiring an additional processor additional precision work.

Figure 10:
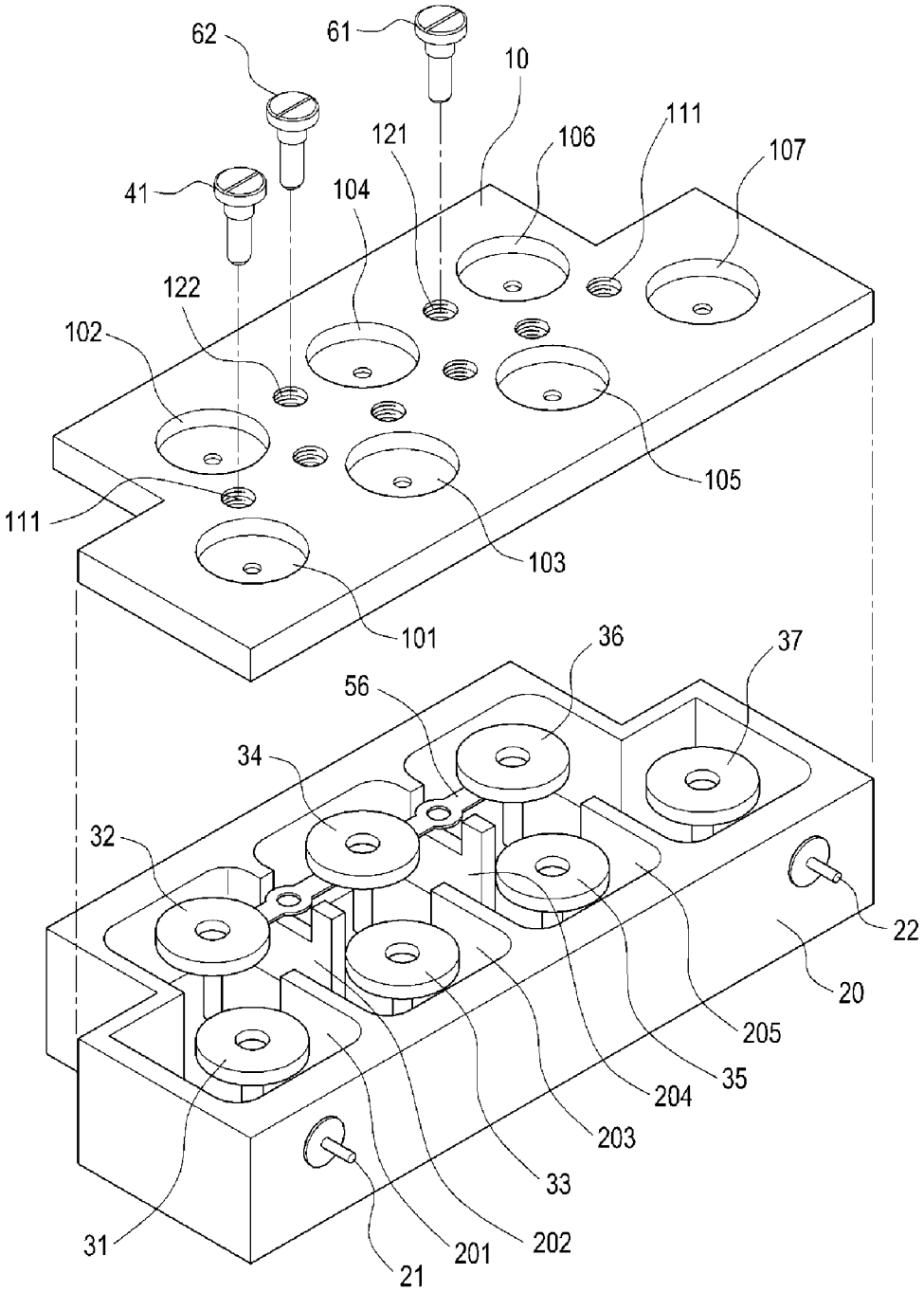
FIG. 10 is a partially separated perspective view of a cavity type wireless frequency filter having a cross-coupling notch structure according to a sixth embodiment of the present invention.

FIG. 10 is a partially separated perspective view of a cavity type wireless frequency filter having a cross-coupling notch structure according to a sixth embodiment of the present invention. Referring to FIG. 10, the wireless frequency filter according to the sixth embodiment of the present invention is substantially the same as the structure shown in FIG. 1 except that, as a notch structure according to the sixth embodiment of the present invention, a notch substrate 56 is also installed for cross-coupling between the second resonant element 32 and the fourth resonant element 3 in addition to between the fourth resonant element 34 and the sixth resonant element 36. At this point, a window having a shape from which an appropriate portion is removed to allow a corresponding notch substrate 56 to be installed is formed at the partition wall 204 between the fourth resonant element 34 and the sixth resonant element 36 and at the partition wall 202 between the second resonant element 32 and the fourth resonant element 34.

Further, a first notch tuning through-hole 121 to which a first notch tuning pin 61 is coupled is formed at a portion of the cover 10, which corresponds to the notch substrate 56, so as to tune a notch characteristic between the fourth resonant element 34 and the sixth resonant element 36, and a second notch tuning through hole 122 to which a second notch tuning pin 62 is coupled is formed at a portion of the cover 10, which corresponds to the notch substrate 56, so as to tune a notch characteristic between the second resonant element 32 and the fourth resonant element 34.

Figure 11:
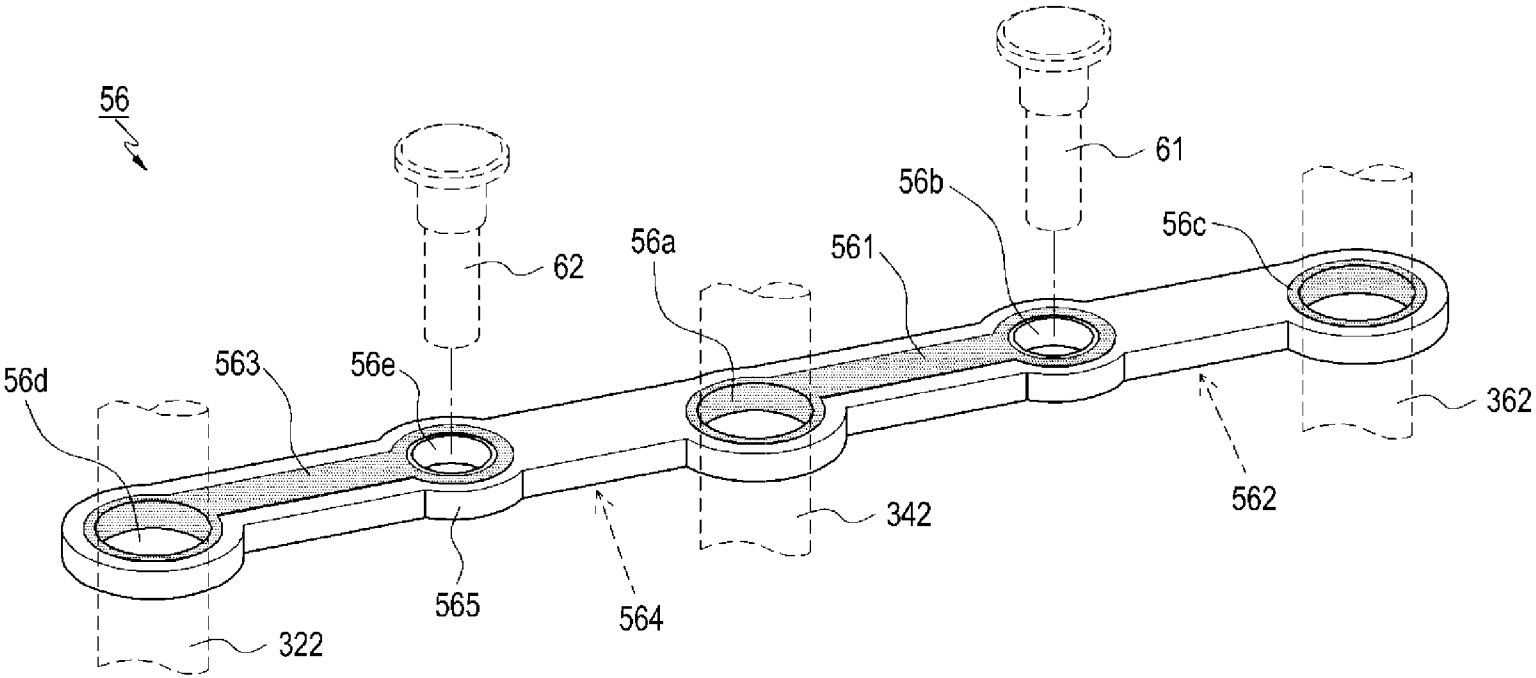
FIG. 11 is a detailed perspective view of a notch substrate of FIG. 10.

FIG. 11 is a detailed perspective view of the notch substrate 56 of FIG. 10. Referring to FIG. 11, the notch substrate 56 according to the sixth embodiment of the present invention includes a main substrate 565, and conductive lines 561, 562, 563, and 564 formed on a first surface (e.g., an upper surface) and/or a second surface (e.g., a lower surface) of the main substrate 565.

The main substrate 565 is mechanically coupled to at least three resonant elements, i.e., in an example of FIG. 11, to the support 342 of the fourth resonant element 34, the support 362 of the sixth resonant element 36, and a support 322 of the second resonant element 32, and thus a first coupling structure 56*a*, a second coupling structure 56*c*, and a third coupling structure 56*d* are formed to fixedly support the main substrate 565.

For example, the conductive lines 561, 562, 563, and 564 includes a first sub conductor pattern 561 formed on an upper surface of the main substrate 565 and electrically connected to the support 342 of the fourth resonant element 34, and a second sub conductor pattern 562 formed on a lower surface of the main substrate 565 and electrically connected to the support 362 of the sixth resonant element 36, and the first and second sub conductor patterns 561 and 562 are configured to mutually transmit signals in a non-contact coupling method by interposing the main substrate 565 at a portion of a first tuning hole structure 56*b* formed at the main substrate 565. Further, the conductive lines 561, 562, 563, and 564 includes a third sub conductor pattern 563 formed on the upper surface of the main substrate 565 and electrically connected to the support 322 of the second resonant element 32, and a fourth sub conductor pattern 564 formed on the lower surface of the main substrate 565 and electrically connected to the support 342 of the fourth resonant element 34, and the third and fourth sub conductor patterns 563 and 564 are configured to mutually transmit signals in a non-contact coupling method at a portion of a second tuning hole structure 56*e* formed at the main substrate 565. In FIG. 11, the second sub conductor pattern 562 and the fourth sub conductor pattern 564, which are formed on the lower surface of the main substrate 565, are omitted.

Looking at the structures shown in FIGS. 10 and 11, it can be seen that the structure of the notch substrate 56 according to the sixth embodiment of the present invention is a structure in which the structure of the notch substrate 51 according to the first embodiment shown in FIGS. 1 to 4B is dually formed.

As described above, it can be seen that the notch substrate according to some embodiments of the present invention may be formed by integrating a plurality of notch structures according to a design of a corresponding filter. At this point, even when a plurality of notch structures are integrally manufactured, it can be seen that an additional process or additional precision work may not be required. In this case, when a plurality of notch structures are integrally formed using a single notch substrate, a plurality of coupling structures and a structure of a plurality of conductor patterns of the main substrate may be selectively configured by appropriately mixing the structures of the various embodiments according to a cross-coupling amount, an installation condition, or the like.

As described above, a cavity type wireless frequency filter having a notch structure according to the embodiments of the present invention can be configured. In addition to the foregoing, various embodiments and modifications may be made within the scope of the present invention, and therefore, the scope of the present invention should be defined by the appended claims and equivalents thereof instead of the above-described embodiments.

The invention claimed is:

1. A filter, comprising:

a housing having a hollow therein to provide a plurality of cavities and an open surface at one side of the housing;

a cover for blocking the open surface of the housing;

a plurality of resonant elements disposed in the hollow of the housing; and a notch substrate installed to cross-couple a first resonant element and a second resonant element among the plurality of resonant elements, wherein the notch substrate includes:

a main substrate made of a non-conductive material and having a first coupling structure and a second coupling structure each of which is mechanically coupled to the first resonant element and a second resonant element, respectively; and a set of conductive lines comprising conductor patterns formed on the main substrate and transmitting a signal from the first resonant element to the second resonant element through a non-contact coupling method, wherein the main substrate comprises a notch turning through-hole between the first coupling structure and the second coupling structure, and the filter further comprises a notch tuning pin for tuning a characteristic of the filter, and the notch tuning pin penetrates the notch turning through-hole.

2. The filter of claim 1, wherein the set of conductive lines includes:

a first sub conductor pattern electrically connected to a support of the first resonant element in the first coupling structure of the main substrate; and a second sub conductor pattern electrically connected to a support of the second resonant element in the second coupling structure of the main substrate.

3. The filter of claim 2, wherein each of the first coupling structure and the second coupling structure comprises a through-hole which is fitted into and mechanically coupled to the support of the respective resonant element.

4. The filter of claim 3, wherein the notch tuning pin is coupled to a portion of the cover, and a notch tuning hole structure for forming the notch tuning through-hole having a size corresponding to a lower end portion of the notch tuning pin is formed at a portion of the main substrate of the notch substrate, which corresponds to the notch tuning pin.

5. The filter of claim 4, wherein the first sub conductor pattern and the second sub conductor pattern are configured to mutually transmit the signal through the non-contact coupling method at the portion at which the notch tuning hole structure of the main substrate is formed.

6. The filter of claim 4, wherein a solder injection recess is formed at the through-hole of each of the first and second coupling structures.

7. The filter of claim 3, wherein:

a conductive metal film is formed on an inner surface of each of the through-holes of the first and second coupling structures of the main substrate, the first sub conductor pattern and the second sub conductor pattern are formed on the same surface of the main substrate, a first end of the first sub conductor pattern is connected to the inner surface of the through-hole of the first coupling structure, a first end of the second sub conductor pattern is connected to the inner surface of the through-hole of the second coupling structure, and mutually facing portions between a portion of a second end of the first sub conductor pattern and a portion of a second end of the second sub conductor pattern are formed, and thus the first sub conductor pattern and the second sub conductor pattern are configured to mutually transmit the signal through the non-contact coupling method.

8. The filter of claim 3, wherein:

the first sub conductor pattern and the second sub conductor pattern are formed on the same surface of the main substrate, a first end of the first sub conductor pattern is formed to surround at least a portion of a region forming the through-hole of the first coupling structure and to maintain a separation distance from the through-hole of the first coupling structure, and a first end of the second sub conductor pattern is formed to surround at least a portion of a region forming the through-hole of the second coupling structure and to maintain a separation distance from the through-hole of the first coupling structure.

9. The filter of claim 8, wherein a second end of the first sub conductor pattern and a second end of the second sub conductor pattern are directly connected and integrally formed.

10. The filter of claim 3, wherein:

a conductive metal film is formed on an inner surface of the through-hole of the first coupling structure of the main substrate, a first end of the first sub conductor pattern is connected to the inner surface of the through-hole of the first coupling structure, and a first end of the second sub conductor pattern is formed to surround at least a portion of a region forming the through-hole of the second coupling structure and to maintain a separation distance from the through-hole of the first coupling structure.

11. The filter of claim 10, wherein a second end of the first sub conductor pattern and a second end of the second sub conductor pattern are formed to be directly connected to each other.

12. The filter of claim 3, wherein:

a conductive metal film is formed on an inner surface of each of the through-holes of the first and second coupling structures of the main substrate, the first sub conductor pattern and the second sub conductor pattern are formed on different surfaces of the main substrate, a first end of the first sub conductor pattern is connected to the inner surface of the through-hole of the first coupling structure, a first end of the second sub conductor pattern is connected to the inner surface of the through-hole of the second coupling structure, and mutually facing portions between a second end of the first sub conductor pattern and a second end of the second sub conductor pattern are formed by interposing the main substrate, and thus the first sub conductor pattern and the second sub conductor pattern are configured to mutually transmit the signal through the non-contact coupling method.

13. The filter of claim 3, wherein a solder injection recess is formed at the through-hole of each of the first and second coupling structures.

14. The filter of claim 1, wherein at least a portion of the notch substrate has an arc shape or a bent shape.

15. The filter of claim 1, wherein:

the notch substrate has a structure for cross-coupling with a third resonant element, the first resonant element, and the second resonant element among the plurality of resonant elements, the main substrate of the notch substrate has a third coupling structure which is mechanically coupled to the third resonant element among the plurality of resonant elements, and the set of conductive lines includes a conductive line for transmitting a signal from the first resonant element or the second resonant element to the third resonant element through a non-contact coupling method.

16. The filter of claim 15, wherein:

each of the first coupling structure and the second coupling structure comprises a through-hole which is fitted into and mechanically coupled to the support of the respective resonant element, and the third coupling structure comprises a through-hole which is fitted into and mechanically coupled to a support of the third resonant element.

17. A filter, comprising:

a housing having a hollow therein to provide a plurality of cavities and an open surface at one side of the housing;

a cover for blocking the open surface of the housing;

a plurality of resonant elements disposed in the hollow of the housing; and a notch substrate installed to cross-couple a first resonant element and a second resonant element among the plurality of resonant elements, wherein the notch substrate includes:

a main substrate made of a non-conductive material and having a first coupling structure and a second coupling structure each of which is mechanically coupled to the first resonant element and a second resonant element, respectively; and a set of conductive lines comprising conductor patterns formed on the main substrate and transmitting a signal from the first resonant element to the second resonant element through a non-contact coupling method, wherein at least a portion of the notch substrate has an arc shape or a bent shape.

18. The filter of claim 17, wherein the set of conductive lines includes:

a first sub conductor pattern electrically connected to a support of the first resonant element in the first coupling structure of the main substrate; and a second sub conductor pattern electrically connected to a support of the second resonant element in the second coupling structure of the main substrate.

19. The filter of claim 18, wherein each of the first coupling structure and the second coupling structure comprises a through-hole which is fitted into and mechanically coupled to the support of the respective resonant element.

20. The filter of claim 19, wherein a notch tuning pin for tuning a notch characteristic is coupled to a portion of the cover corresponding to the notch substrate through a notch tuning through-hole, and a notch tuning hole structure for forming a through-hole having a size corresponding to a lower end portion of the notch tuning pin is formed at a portion of the main substrate of the notch substrate, which corresponds to the notch tuning pin.

* * * * *